United States Patent [19]

Moertel

[11] 4,171,556

[45] Oct. 23, 1979

[54] SLIDE FASTENER WITH MOLDED ELEMENTS AND METHOD OF MANUFACTURE

[75] Inventor: George B. Moertel, Conneautville, Pa.

[73] Assignee: Textron Inc., Providence, R.I.

[21] Appl. No.: 817,718

[22] Filed: Jul. 21, 1977

Related U.S. Application Data

[63] Continuation-in-part of Ser. No. 724,223, Sep. 17, 1976, abandoned.

[51] Int. Cl.[2] ..... A44B 19/04

[52] U.S. Cl. ..... 24/205.13 R; 24/205.13 D

[58] Field of Search ..... 24/205.13 R, 205.13 D, 24/205.16 R, 205.12, 205.1 R

[56] References Cited

U.S. PATENT DOCUMENTS

| | | | |
|---|---|---|---|
| 3,114,954 | 12/1963 | Morin | 24/205.13 |
| 3,328,857 | 7/1967 | Burbank | 24/205.13 |
| 3,414,948 | 12/1968 | Cuckson et al. | 24/205.13 |
| 3,445,915 | 5/1969 | Cuckson et al. | 29/408 |
| 3,487,531 | 1/1970 | Cuckson et al. | 29/410 |
| 3,508,304 | 4/1970 | Burbank | 24/205.13 |
| 3,696,473 | 10/1972 | Jones | 24/205.1 |

FOREIGN PATENT DOCUMENTS

| | | | |
|---|---|---|---|
| 1152073 | 8/1963 | Fed. Rep. of Germany | 24/205.13 |

*Primary Examiner*—Kenneth J. Dorner

*Attorney, Agent, or Firm*—O'Brien and Marks

[57] ABSTRACT

In a woven slide fastener employing spaced coupling elements molded on connecting threads wherein the weft thread loops around the connecting threads between each element to secure the coupling elements to the edge of the tape, the connecting threads are reinforced between the elements by molded projections, sheaths, webs, or the like integral with the coupling elements. Additionally there are disclosed offset heel portions of coupling element legs to increase slider flange engaging surfaces.

10 Claims, 27 Drawing Figures

FIG. 5
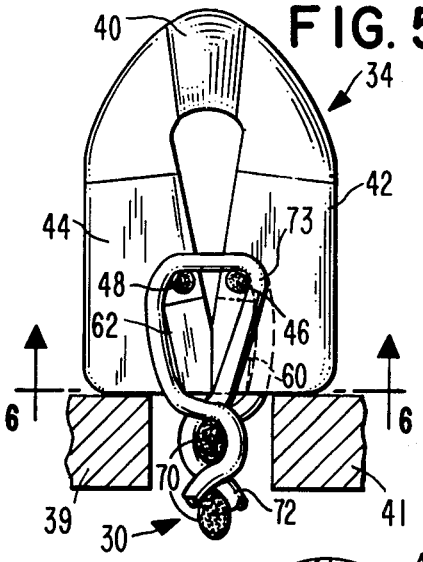
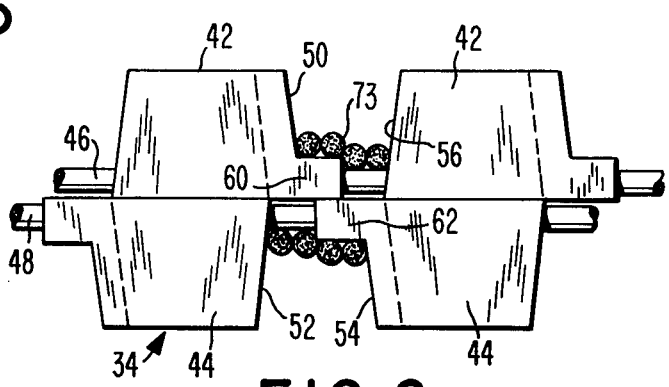
FIG. 6
FIG. 7
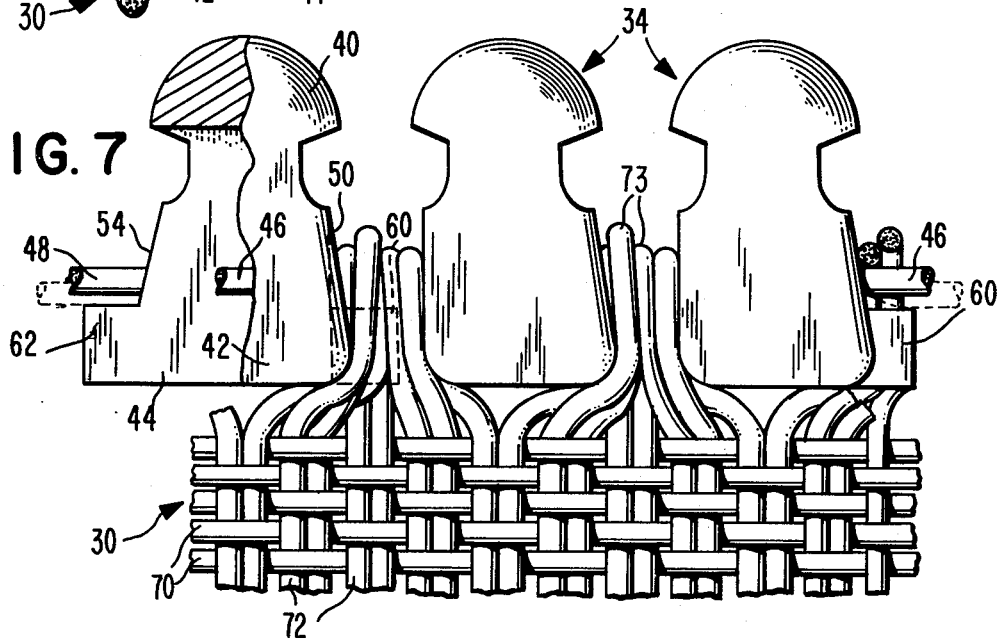
FIG. 8
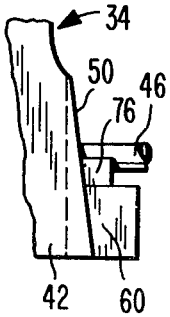
FIG. 9
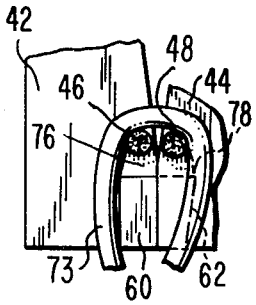
FIG. 10
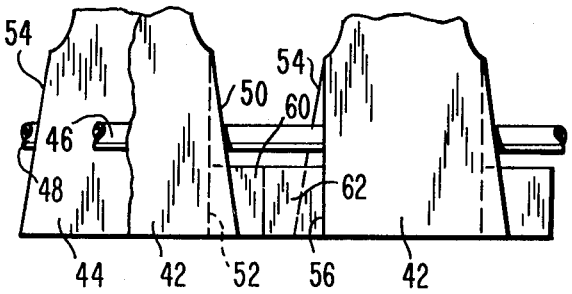

FIG.11
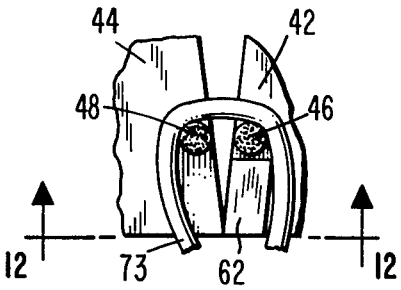
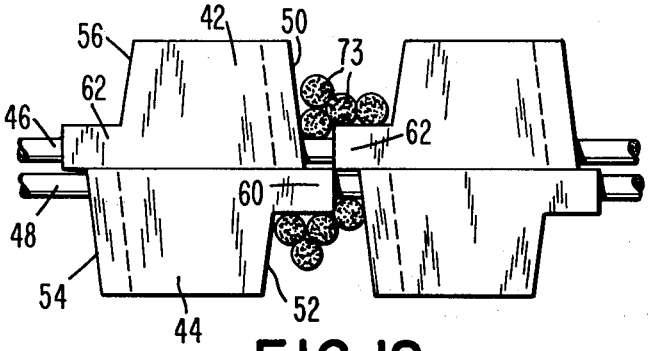
FIG. 12
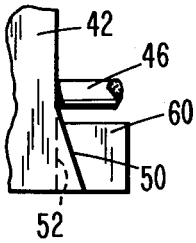
FIG. 13
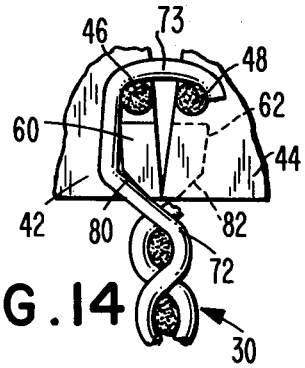
FIG. 14
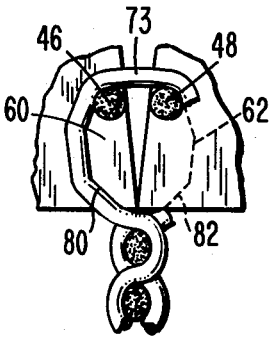
FIG. 15
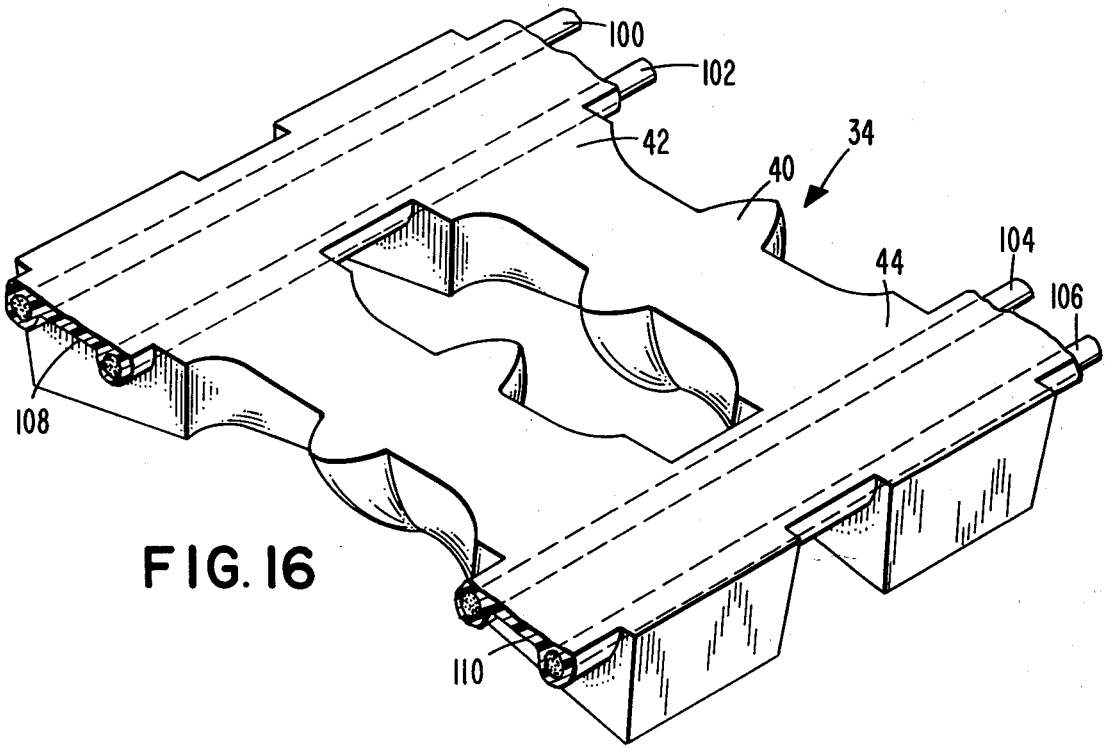
FIG. 16

FIG. 17
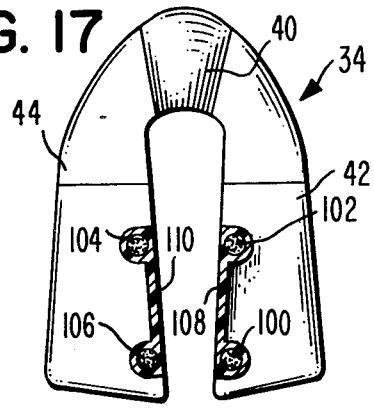
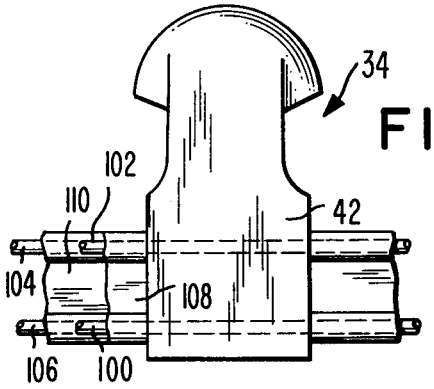
FIG. 18
FIG. 19
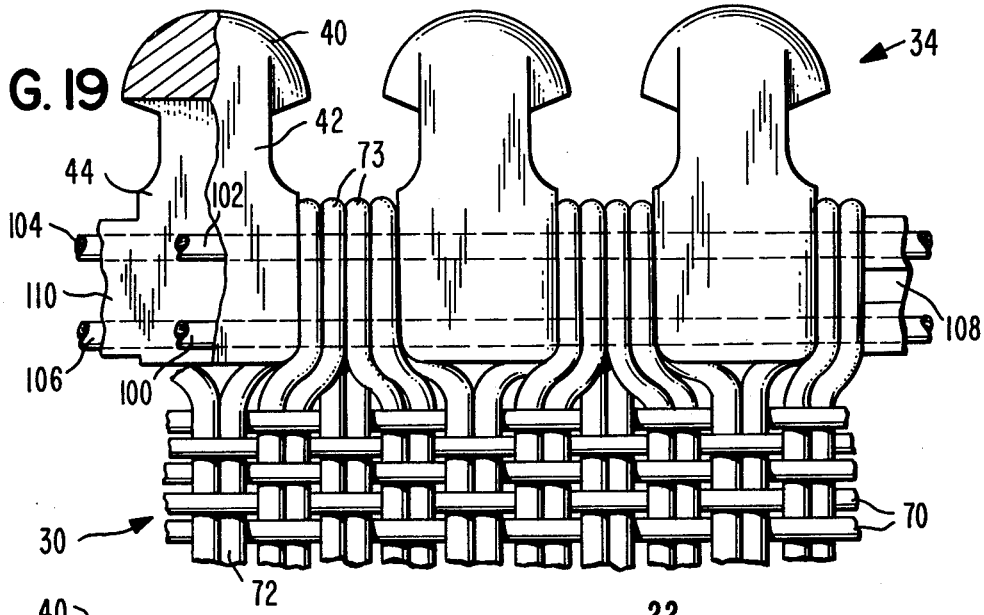
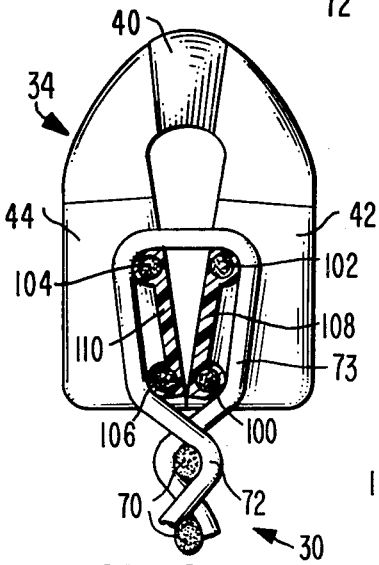
FIG. 20
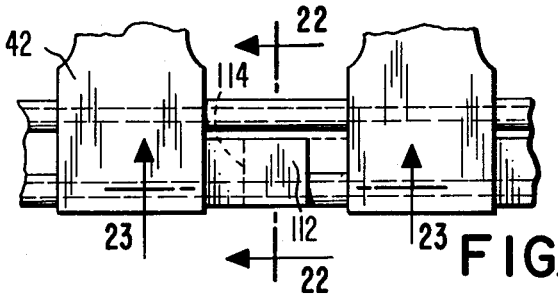
FIG. 21
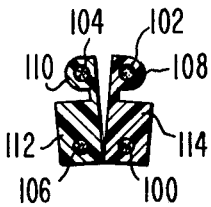
FIG. 22
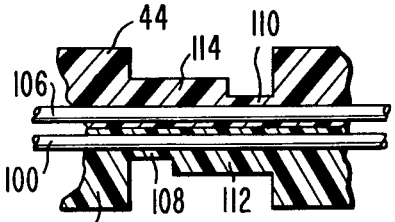
FIG. 23

FIG. 24
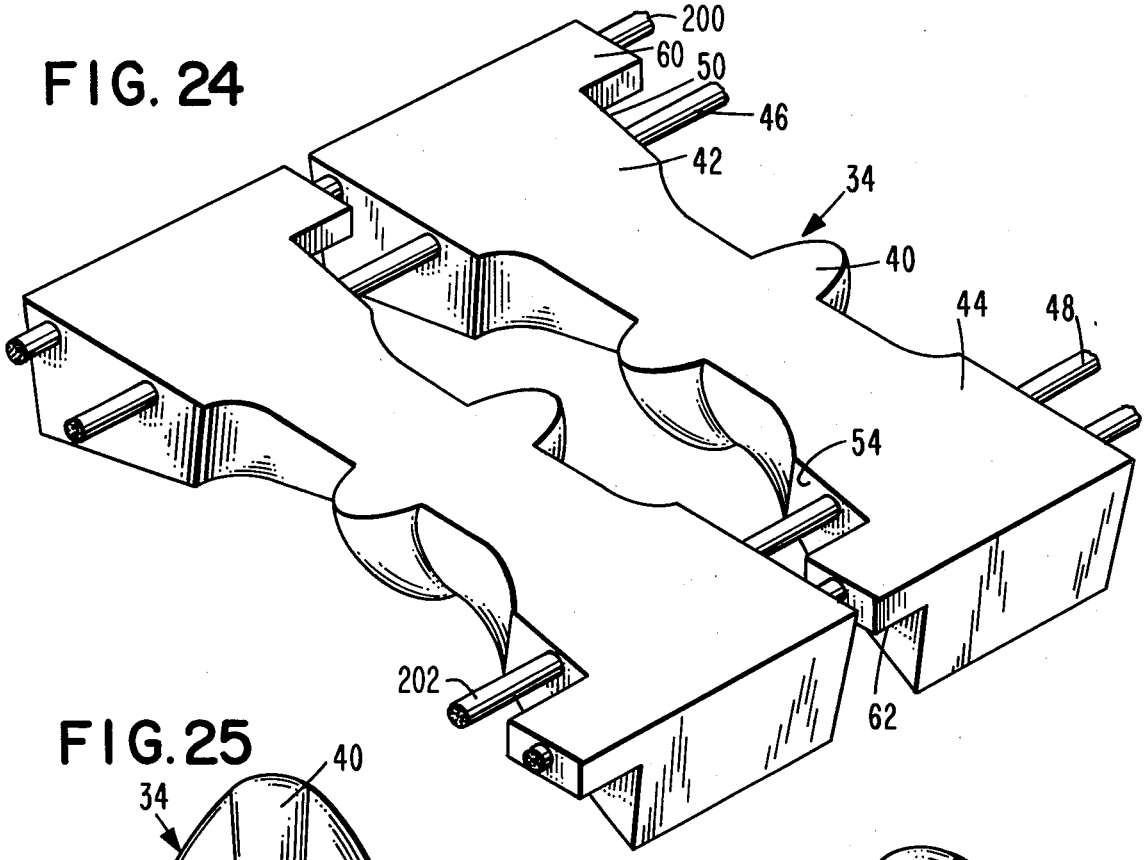
FIG. 25
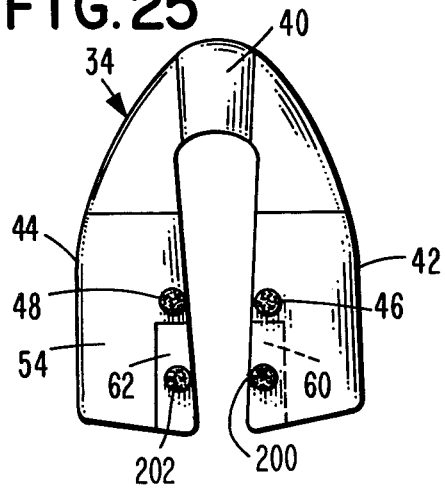
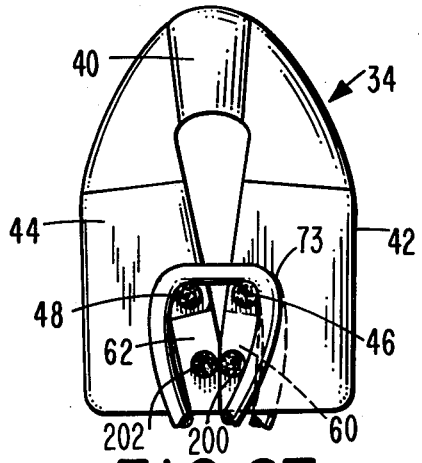
FIG. 27
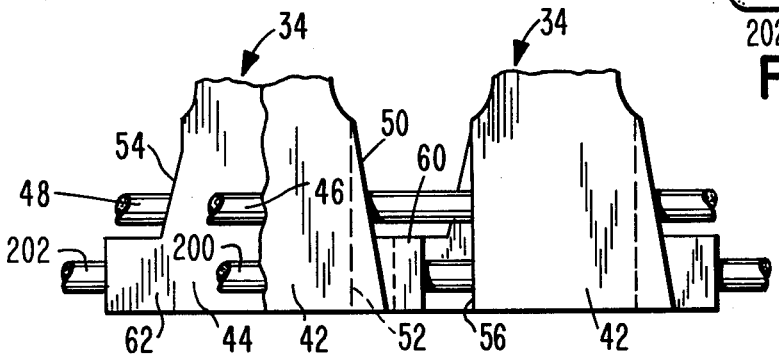
FIG. 26

SLIDE FASTENER WITH MOLDED ELEMENTS AND METHOD OF MANUFACTURE

CROSS-REFERENCE TO RELATED APPLICATION

This application is a continuation-in-part application of my copending U.S. application Ser. No. 724,223 filed Sept. 17, 1976, now abandoned, which is incorporated herein by reference.

BACKGROUND OF THE INVENTION

1. Field of the Invention

This invention relates to slide fasteners and particularly to woven slide fasteners employing polymer coupling elements molded on connecting threads and methods of manufacture.

2. Description of the Prior Art

The prior art, as exemplified in U.S. Pat. Nos. 3,328,857; 3,414,948; 3,445,915; 3,487,531 and 3,696,473, includes a number of slide fasteners employing polymer coupling elements molded on connecting threads wherein the coupling elements are initially molded in a flat condition and then the leg portions are folded together or toward each other; the attachment of such prior art coupling elements to the edge of the tape is either by threads such as stitching threads or warp threads passing over leg portions of the coupling elements or by threads such as weft threads passing around the connecting threads between the coupling elements. However, where conventional weaving apparatus and techniques are employed to secure such coupling element trains to the edge of the tape by looping the weft thread around the connecting threads, inferior slide fasteners have resulted due to (1) the connecting threads being shallowly embedded within the coupling elements and easily pulled out and thus providing insufficient support for the coupling elements against crosswise forces on the slide fastener, and (2) the coupling elements tending to rotate or twist relative to one another about an axis defined by the edge of the tape supporting the coupling elements since the connecting threads do not have sufficient rigidity to prevent such twisting which results in difficulty or failure in the coupling between opposite coupling elements of mating stringers. Reinforcement in the union between the coupling elements and the connecting threads has been previously suggested by welding the heel portions of the legs together adjacent to the connecting threads to thus embed the connecting threads centrally within the joined heel portions; but such welding requires additional apparatus and procedures increasing the cost of the slide fastener. The above U.S. Pat. No. 3,328,857 discloses sections of cord covered with molded plastic material in alternate and staggered spaces between legs to make the coupling elements more stable; however the problem of insufficient union between the coupling threads and the coupling elements is not overcome by such structure. Additionally the force required to open and close such prior art fasteners by moving the slider is sometimes excessively large and uneven.

SUMMARY OF THE INVENTION

The invention is summarized in a woven stringer for a slide fastener including a woven tape having a plurality of warp threads and a weft thread interwoven with the warp threads, a coupling element train having first and second connecting threads and a plurality of spaced polymer coupling elements molded on the connecting threads, each of the coupling elements having a head portion and first and second leg portions extending in generally the same direction from opposite sides of the head portion, the first leg portions being spaced to define first spaces between adjacent first leg portions on a first side of the coupling elements, the second leg portions being spaced to define second spaces between adjacent second leg portions on a second side of the coupling elements, the first and second connecting threads having spaced embedded segments which are embedded in the respective first and second leg portions of the coupling elements and having spaced connecting segments which extend across the respective first and second spaces to join the coupling elements together, first and second pluralities of reinforcing means molded integral with the respective first and second leg portions of the coupling elements and extending into all the respective first and second spaces between the leg portions to reinforce all of the connecting segments, the reinforcing means having a thickness less than a thickness of the leg portions, the weft thread having a plurality of loops on one longitudinal edge of the tape, and the plurality of loops each encircling both connecting segments and at least one reinforcing means together between the first and second leg portions of adjacent coupling elements to secure the train to the one edge of the tape and to hold the pair of leg portions of each coupling element together.

An object of the invention is to construct a strong, reliable, and easy operating slide fastener employing polymer coupling elements molded on continuous threads which are woven in one longitudinal edge of a support tape.

Another object of the invention is to eliminate extra cords and threads previously necessary to attach molded coupling elements to a support tape.

It is also an object of the invention to eliminate extra steps, such as welding or reheating prior to folding, in the manufacture of woven slide fasteners with folded molded coupling elements.

One advantage of the invention is that reinforcements such as molded projections, sheaths, webs and the like, for connecting thread segments between coupling elements bear part of the lateral loading on the slide fastener to reduce stress on the connecting threads.

Another advantage is that the reinforcements encircled together with connecting thread segments by weft thread loops between adjacent coupling elements are engaged by the loops to hold the pair of legs of each coupling element together, thus increasing the resistance of the connecting thread segments embedded near the inside surfaces of the coupling elements from being torn from the coupling elements.

Still another advantage of the invention is that reinforcements such as overlapping reinforcements from adjacent coupling elements substantially reduce twisting of the coupling elements relative to one another about an axis in the edge of the tape without reducing flexibility in the plane of the tape.

An additional feature of the invention is the folding of the polymer coupling elements immediately after the coupling elements have solidified after molding but prior to cooling to a temperature below which the elements can be plastically reformed.

Yet another feature of the invention is the extension of the pair of heel portions of each coupling element in opposite directions along the longitudinal dimensions of the tape to increase the length of slider flange engagement of each coupling element and to thus make slider movement easier and more even while providing adequate spacing between coupling elements to accomodate the weft thread loops.

Other objects, advantages and features of the invention will be apparent from the following description of the preferred embodiment taken in conjunction with the accompanying drawings.

BRIEF DESCRIPTION OF THE DRAWINGS

FIG. 5 is a cross-section view of a broken-away portion of the fastener of FIG. 1.

FIG. 6 is a cross-sectional view taken along line 6—6 of FIG. 5.

FIG. 7 is an enlarged plan view of the broken-away portion of FIG. 5.

FIG. 8 is a plan view of a portion of a coupling element train showing a modification of the train of FIGS. 1–7.

FIG. 9 is a cross-section view of the modified portion shown in FIG. 8.

FIG. 10 is a plan view of a second modification of the fastening element train.

FIG. 11 is a cross-section view of the modified coupling element train in FIG. 10.

FIG. 12 is a cross-section view taken along line 12—12 of FIG. 11.

FIG. 13 is a plan view of a portion of a coupling element train having a third modification.

FIG. 14 is a cross-section view of a cutaway portion of the train in FIG. 13 attached to a tape portion.

FIG. 15 is a view similar to FIG. 14 of a fourth modification of the coupling element train.

FIG. 16 is a perspective view of another variation of the train of coupling elements in an unfolded condition.

FIG. 17 is a cross-section view of the coupling element train variation of FIG. 16 in a folded condition.

FIG. 18 is a plan view of the folded coupling element train variation of FIG. 16.

FIG. 19 is a plan view of a cutaway portion of a slide fastener stringer including the variation of FIGS. 16–18.

FIG. 20 is a cross-sectional side view of the stringer portion of FIG. 19.

FIG. 21 is a plan view of a modification of the variation of FIGS. 16–20.

FIG. 22 is a cross sectional view taken along line 22—22 of FIG. 21.

FIG. 23 is a cross sectional view taken along line 23—23 of FIG. 21.

FIG. 24 is a perspective view of still another variation of the train of polymer fastening elements prior to folding and attaching to the edge of a tape.

FIG. 25 is a cross-section view of the train of coupling elements of FIG. 24 after being folded.

FIG. 26 is a plan view of the folded coupling element train of FIG. 25 with portions broken away.

FIG. 27 is a cross-section view of the folded train of FIGS. 25 and 26 after attachment to the edge of a tape.

DESCRIPTION OF THE PREFERRED EMBODIMENT

Figure 1:
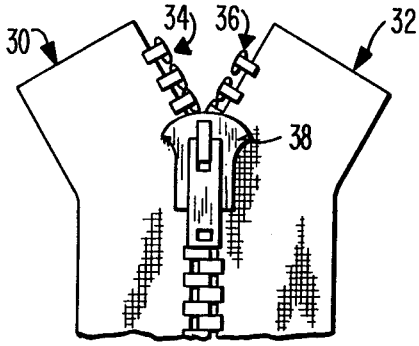
FIG. 1 is a plan view of a slide fastener in accordance with the invention.

A slide fastener, as shown in FIG. 1 and manufactured in accordance with the invention, includes a pair of planarly disposed support tapes indicated generally at 30 and 32 and a pair of trains of coupling elements indicated generally at 34 and 36 attached to the respective inner edges of the tapes 30 and 32. A slider 38 is slidably mounted on the coupling elements 34 and 36 for opening and closing the slide fastener. As viewed in FIG. 1, the tape 30 and the coupling elements 34 form a left stringer of the slide fastener while the tape 32 and coupling elements 36 form a right stringer. The left and right stringers when interlocked together form a chain for the slide fastener. The right stringer is substantially identical to the left stringer except for being a mirror image thereof; thus for the sake of brevity only the left stringer is described in detail.

Figure 2:
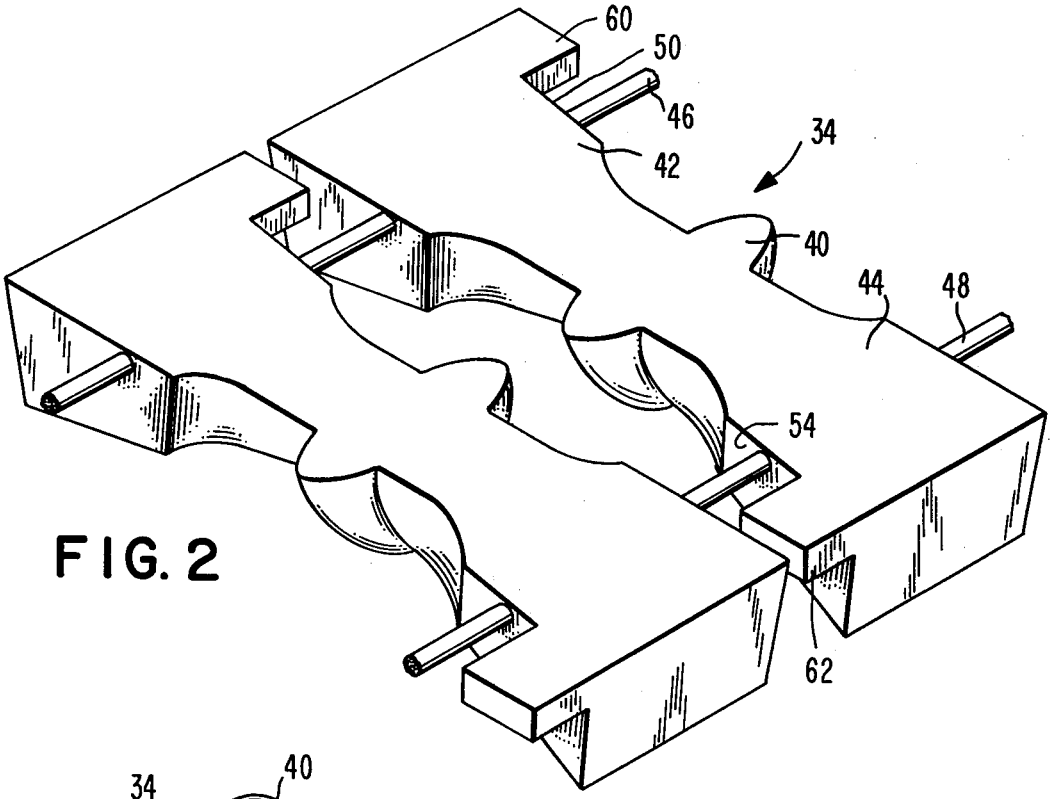
FIG. 2 is a perspective view of a train of polymer fastening elements prior to folding and attaching to the edge of a tape in the fastener of FIG. 1.
Figure 3:
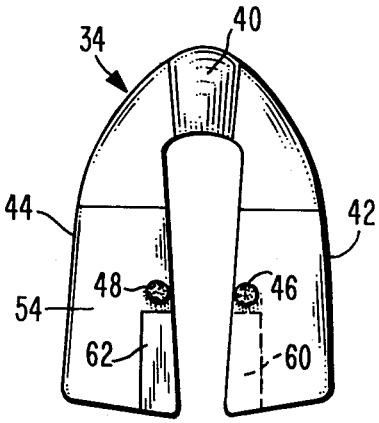
FIG. 3 is a cross-section view of the train of coupling elements of FIG. 2 after being folded.
Figure 4:
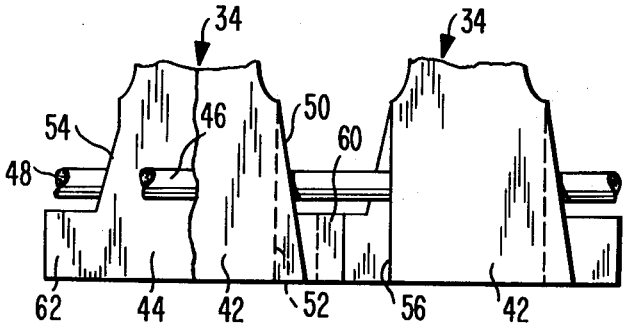
FIG. 4 is a plan view of the folded coupling element train of FIG. 3 with portions broken away.

As illustrated in FIG. 2, the train of coupling elements 34 is initially flat. Each of the coupling elements 34 includes a head portion 40 and a pair of leg portions 42 and 44 extending in opposite directions from the head portion 40. The leg portions 42, at intermediate points toward the heels thereof opposite the head portions 40, are molded around respective connecting threads 46 and 48; the threads 46 and 48 having embedded segments in the respective leg portions 42 and 44, and having connecting segments extending across the spaces between respective leg portions 42 and 44 of adjacent coupling elements to connect the coupling elements 34 in the train. The train of coupling elements 34 are molded from a molten polymer, such as a thermoplastic resin, in a suitable apparatus, such as a conventional injection molding machine with a cavity wheel having a row of cavities with grooves for receiving the connecting threads 46 and 48 intersecting leg forming portions of the cavities. The connecting threads 46 and 48 are only shallowly embedded with respect to the inside surface, i.e. the upper surface shown in FIG. 2, of the leg portions 42 and 44. After solidification of the polymer but while the coupling elements 34 are still in an elevated temperature at which the polymer can be plastically reformed, the coupling elements 34 are removed from the molding apparatus and the leg portions 42 and 44 are bent or folded to extend in generally the same direction from opposite sides of the head portion 40 as shown in FIGS. 3 and 4; this bending while still hot after molding eliminates an extra reheating step necessary for folding.

The leg portion 42 is asymmetrical and has a surface 50 on one side which is inclined outwardly (with respect to the vertical as viewed in FIG. 4) progressing toward the heel while the surface 56 on the opposite side of leg 42 is straight (i.e. vertical as viewed in FIG. 4) or perpendicular to the thread 46; similarly the leg portion 44 is asymmetrical with one side surface 54 inclined and the other side surface 52 straight. The inclined surface 54 is on the front side of each coupling element 34 as viewed in FIG. 3 while the inclined surface 50 is on the back side so that extensions of the respective leg portions 42 and 44 of each coupling element are offset or formed in opposite directions parallel to the train into spaces between leg portions of adjacent coupling elements at the heels of the respective leg portions. Bottom surfaces of these extensions are such as to extend the slider flange engaging bottom surfaces of the heels of the leg portions 42 and 44 parallel to the train of coupling elements.

The coupling elements 34 also each have reinforcing means for the connecting threads 46 and 48, such as respective integrally molded projections 60 and 62 extending from the inclined surfaces 50 and 54 of the leg portions 42 and 44. The projections 60 and 62 have (1) a thickness, i.e. the horizontal dimension shown in FIG. 3, which is slightly greater than the thickness of the connecting threads 46 and 48 but substantially less than the thickness of the leg portions 42 and 44, (2) a width, i.e. the vertical dimension shown in FIGS. 3 and 4, which extends from the heel of the leg portions 42 and 44 to upper edges or shelves slightly spaced below the connecting threads 46 and 48 such that forces on the connecting threads 46 and 48 cause engagement of the connecting threads 46 and 48 upon the projections 60 and 62 as illustrated in phantom in FIG. 7, and (3) a length, i.e. the horizontal dimension shown in FIG. 4, to extend slightly more than half the distance between the adjacent coupling elements 34 such that the projections 60 and 62 from respective adjacent coupling elements have end portions which overlap. The projections 60 and 62 are substantially more rigid than the connecting threads 46 and 48.

As illustrated in FIGS. 5, 6, and 7, the tape 30 includes a plurality of warp threads 60 with an interwoven weft thread 72 which has loop portions 73 extending around the connecting threads 46 and 48 and the projections 60 and 62 between the coupling elements 34 to secure the train of coupling elements 34 to the edge of the tape 30. Weaving of the weft thread 72 with the warp threads 70 and the train of coupling elements is performed on a conventional slide fastener stringer weaving apparatus. There are a plurality of loops 73, such as four loops, between each coupling element. The length of the projections 60 and 62 insures that at least one or more of the loops 73 engage each of the projections 60 and 62 in each space between adjacent coupling elements. The tension of the weft thread 72 engaging the connecting threads 46 and 48 and the projections 60 and 62 holds the leg portions 42 and 44 together at their heels, particularly when the tape is under crosswise tension. When the leg portions of the coupling elements are spaced apart after folding as shown in FIG. 3, the weft thread during weaving pulls the leg portions together at the heels as shown in FIG. 5.

The thickness of the leg portions 42 and 44 is substantially greater than the sum of the thicknesses of the projections 60 and 62 and the weft thread loops 73 such that the loops 73 are retained between the leg portions 42 and 44 and the heels of the leg portions 42 and 44 project substantially above the opposite sides of the tape 30 for engagement with flanges 39 and 41 of the slider 38. Thus the weft thread 72 and its loops 73 are not exposed to wear from the slider passing over the elements 34.

The reinforcements or the projections 60 and 62 provide substantial support or reinforcement for the connecting threads 46 and 48. Under crosswise force on the tape 30, the connecting threads 46 and 48 engage the projections 60 and 62; thus the projections 60 and 62 bear a substantial portion of the crosswise forces of the slide fastener. Also the reinforcement of the connecting threads results in the leg portions 42 and 44 being held tightly together adjacent the heels such that the engagement of the inside surfaces of the leg portions near the heels thereof strengthens the union of the connecting threads with the leg portions; in the absence of the reinforcement, the connecting threads are too flexible and will not hold the leg portions of the coupling elements together with sufficient force to adequately strengthen the union of the connecting threads with the leg portions.

Further, the reinforcement between coupling elements tends to prevent rotation of the elements 34 relative to one another about an axis in the edge of the tape. The weft thread loops 73 secure the flat overlapping surfaces of the projections 60 and 62 from adjacent elements together which retards relative twisting about the axis in the tape edge but does not substantially hinder the bending of the train of coupling elements in the plane of the tape, i.e. parallel to the overlapping flat surfaces of the projections, during engagement and disengagement of the coupling elements by movement of the slider.

The angled or inclined portions formed by the surfaces 50 and 54 provide substantial extensions of the slider flange engaging surfaces on the heels of the coupling elements; such extensions causes smoother and easier operation of the slider 38 by reducing gaps between slider flange engaging surfaces. Engagement of slider flanges 39 and 41 with the heels of the leg portions is shown in FIG. 5. The staggering of the heel extensions, i.e. the angled surfaces 50 and 54 being on opposite legs and on opposite sides, leaves sufficient space between adjacent legs portions on each side of the train to accommodate the loops 73 of thread.

Additionally, having the projections 60 and 62 mounted on the inclined portions 50 and 54 permits the projections 60 and 62 to be relatively short so that they are not easily bent or broken. Where the reinforcements or projections 60 and 62 are substantially rigid, they can not extend completely across between adjacent coupling elements without reducing the flexibility of the train in coupling and uncoupling with a mating train; the freedom of the connecting thread segments between adjacent coupling elements permits this flexibility to allow easy slider action.

In a modification as shown in FIGS. 8 and 9 of the slide fastener, protrusions 76 and 78 are molded on the upper edge of the projections 60 and 62 between the respective connecting threads 46 and 48 and the projections 60 and 62. The protrusions 76 and 78 have a length less than the length of the projections 60 and 62 extending from the angled surfaces 50 and 54 to rigidly support the connecting threads 46 and 48 adjacent the surfaces 50 and 54 without allowing limited movement of the segments of connecting threads 46 and 48 over the protrusions 76 and 78. The protrusions 76 and 78 provide for more support of the connecting threads 46 and 48, particularly adjacent to the surfaces 50 and 54, but still allow flexibility of segments of the connecting threads 46 and 48 not overlying the protrusions 76 and 78 between coupling elements.

In another modification shown in FIGS. 10, 11 and 12 of the slide fastener, the projections 60 and 62 extend from the straight surfaces 52 and 56 of the respective leg portions 44 and 42 instead of from the inclined surfaces 50 and 54 of the leg portions 42 and 44. Also the projections 60 and 62 do not overlap at their end portions but extend just to points midway between the coupling elements. The angled surfaces 50 and 54 still result in extension of the slider engaging surfaces of the heel portions of the coupling elements 34 while the projections reinforce the connecting threads 46 and 48 and their union with the leg portions 42 and 44.

Illustrated in FIG. 13, a third modification of the slide fastener has the angled surface 50 extending from a point just below the connecting thread 46 to the heel of the leg portion 42 instead of from a point substantially above the connecting thread 46 as shown in FIGS. 4 and 7. The angled surface 54 (not shown in FIG. 13) has a similar construction. The angling of the surfaces 50 and 54 as shown in the modification of FIG. 13 also extends the slider engaging surfaces of the heels of the leg portions 42 and 44.

A fourth modification in FIG. 14 shows the bottom outside corners of the projections 60 and 62 being canted or rounded at 80 and 82 to avoid sharp corners over which the weft thread 72 extends. This permits the loops 73 to be tighter on the edge of the tape 30.

In a fifth modification of the slide fastener as shown in FIG. 15, the upper edges of the projections 60 and 62 engage the connecting threads 46 and 48 throughout the length of the projections 60 and 62 providing a more rigid support for the connecting threads of the coupling element train.

Another variation of the coupling element train shown in FIGS. 16, 17, 18, 19 and 20 includes four spaced and parallel connecting threads 100, 102, 104, and 106 wherein each of the leg portions 42 and 44 of the coupling elements 34 are molded on a spaced pair of the connecting threads 100, 102, 104 and 106, respectively. Thin sheaths 108 and 110 of the polymer forming the coupling elements are molded on the respective pairs of connecting threads 100, 102, 104 and 106 and extend between the respective pairs of connecting threads and the adjoining coupling elements 34. The sheaths 108 and 110 have a suitable thickness and dimension reinforcing the connecting threads 100, 102, 104 and 106 so as to permit some flexibility but to absorb a substantial amount of cross-wise forces from the tapes as well as to cooperate with the thread 72 and loops 73 to secure the heel portions of the leg portions 42 and 44 together. The pairs of spaced threads 100, 102, 104 and 106 provide a substantially stronger attachment of the coupling element to the edge of the tape while the sheaths 108 and 110 further reinforce this attachment. Also the sheaths 108 and 110 tend to prevent rotation of the elements 34 relative to one another about an axis in the edge of the tape 30.

In a modification illustrated in FIGS. 21, 22 and 23 of the variation shown in FIGS. 16–20, the sheaths 108 and 110 are further reinforced with enlarged portions or projections 112 and 114 extending in opposite directions from the side surfaces of the respective leg portions 42 and 44 in a manner similar to the projections 60 and 62 shown in FIGS. 2–7. The enlarged portions 112 and 114 further reinforce the connecting threads 100, 102, 104 and 106.

As shown in FIGS. 24, 25, 26, and 27, a still further variation of the train of coupling elements 34 woven in the edge of the tape has a configuration substantial the same as the train of elements 34 in FIGS. 1–7 except that there is included connecting threads 200 and 202 parallel to the connecting threads 46 and 48. The connecting threads 200 and 202 have segments embedded in the heels of the respective leg portions 42 and 44 as well as in the projections 60 and 62. Segments of the threads 200 and 202 extend between the ends of the projections 60 and 62 and the respective surfaces 56 and 52 of the leg portions 42 and 44. The additional connecting threads 200 and 202 being embedded in the projections 60 and 62 reinforce the projections 60 and 62 reducing any tendency of the projections 60 and 62 to be broken off of the elements 34. Further the spacing of the connecting threads 200 and 202 from the connecting threads 46 and 48 results in increased stability of the coupling element train while the free segments between coupling elements still permit free bending of the elements apart by pivotal movement of the elements in the plane of the tape during coupling and uncoupling by the slider.

Since many modifications, variations, and changes in detail may be made to the above described embodiment, it is intended that all matter in the foregoing description and shown in the accompanying drawings be interpreted as illustrative and not in a limiting sense.

What is claimed is:

1. A woven stringer for a slide fastener comprising a woven tape having a plurality of warp threads and a weft thread interwoven with the warp threads, a coupling element train having first and second connecting threads and a plurality of spaced polymer coupling elements molded on the connecting threads, each of said coupling elements having a head portion and first and second leg portions extending in generally the same direction from opposite sides of the head portion, said first leg portions being spaced to define first spaces between adjacent first leg portions on a first side of the coupling elements, said second leg portions being spaced to define second spaces between adjacent second leg portions on a second side of the coupling elements, said first and second connecting threads having spaced embedded segments which are embedded in the respective first and second leg portions of the coupling elements and having spaced connecting segments which extend across the respective first and second spaces to join the coupling elements together, first and second pluralities of reinforcing means including respective first and second pluralities of projections molded integral with the respective first and second leg portions of the coupling elements and extending into and only partially across all the respective first and second spaces between the leg portions to reinforce all of the connecting segments, said projections having a thickness less than a thickness of the leg portions, said first plurality of projections extending in only one direction from the respective first leg portions, said second plurality of projections extending in only the opposite direction from the respective second leg portions and having end portions which overlap end portions of the first plurality of projections, said weft thread having a plurality of loops on one longitudinal edge of the tape, and said plurality of loops each encircling both connecting segments and at least one projection together between the first and second leg portions of adjacent coupling elements to secure the train to the one edge of the tape and to hold the pair of leg portions of each coupling element together.

2. A woven stringer as claimed in claim 1 wherein the projections extend from the respective leg portions between the connecting threads and heels of the leg portions.

3. A woven stringer as claimed in claim 2 wherein the projections are slightly spaced from the connecting threads.

4. A woven stringer as claimed in claim 2 wherein the projections engage the connecting threads throughout the length of the projections.

5. A woven stringer as claimed in claim 1 wherein the coupling element train has third and fourth connecting threads with segments embedded in the respective first and second leg portions.

6. A stringer for a slide fastener comprising a support tape, a train of spaced coupling elements each having a head portion and a pair of leg portions extending in generally the same direction from opposite sides of the head portion, said leg portions having slider-flange-engaging bottom surfaces, a pair of connecting threads each having spaced embedded segments which are embedded in the leg portions on respective sides of the coupling elements and having spaced connecting segments which extend between adjacent leg portions on respective sides of the coupling elements to join the coupling elements together, said support tape including a plurality of warp threads and a weft thread interwoven with the warp threads, said weft thread forming a plurality of loops on one longitudinal edge of the tape and encircling the connecting segments in the spaces between adjacent coupling elements, said leg portions having a thickness substantially greater than a thickness of the loops and the connecting thread segments to retain the loops in the spaces between the leg portions and to extend the slider-flange engaging surfaces substantially above the plurality of loops and support tape, said leg portions each having one side which is perpendicular to the one edge of the tape, the opposite side of each leg portion being inclined outwardly from the head portion relative to the one side, said pair of leg portions of each coupling element having respective extensions formed by inclined portions defined by the opposite sides of the respective leg portions, said extensions having bottom surfaces extending the slider-flange-engaging bottom surfaces of the leg portions, and said extensions of the pair of leg portions of each coupling element extending only in opposite directions from the respective leg portions parallel to one edge of the tape into the spaces between leg portions of adjacent coupling elements on respective sides of the train.

7. A stringer as claimed in claim 6 including a plurality of reinforcing means molded integral with the coupling elements and extending into the spaces between adjacent leg portions on respective sides of the coupling elements to reinforce all of the connecting segments, said plurality of loops on the one longitudinal edge of the tape also encircling the reinforcing means in the spaces between adjacent coupling elements, and said leg portions having a thickness substantially greater than a thickness of the reinforcing means to retain the loops between the leg portions and to extend the slider-flange engaging surfaces substantially above the plurality of loops and support tape.

8. A stringer as claimed in claim 7 wherein the plurality of reinforcing means includes a plurality of projections extending partially across the spaces between adjacent coupling elements.

9. A stringer as claimed in claim 8 wherein the projections extend from the inclined portions on opposite sides of the element.

10. A stringer as claimed in claim 8 wherein the train of coupling elements are molded in a flat condition with the connecting threads embedded in the leg portions, and the train of coupling elements are subsequently folded to bring the leg portions together.

* * * * *